US007518312B2

(12) United States Patent
Kweon

(10) Patent No.: US 7,518,312 B2
(45) Date of Patent: Apr. 14, 2009

(54) PLASMA DISPLAY PANEL (PDP) HAVING LOW CAPACITANCE AND HIGH DISCHARGE EFFICIENCY

(75) Inventor: Tae-Joung Kweon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 399 days.

(21) Appl. No.: 11/353,001

(22) Filed: Feb. 14, 2006

(65) Prior Publication Data

US 2006/0192489 A1 Aug. 31, 2006

(30) Foreign Application Priority Data

Feb. 28, 2005 (KR) ..... 10-2005-0016358

(51) Int. Cl.

| | |
|---|---|
| ***H01J 17/49*** | (2006.01) |
| ***H01J 17/16*** | (2006.01) |
| *G09G 3/28* | (2006.01) |
| *H01J 1/02* | (2006.01) |

(52) U.S. Cl. ..... 313/586; 313/581; 313/584; 315/169.1; 315/169.3

(58) Field of Classification Search ... 315/169.1–169.3; 313/581–587

See application file for complete search history.

(56) References Cited

U.S. PATENT DOCUMENTS

2002/0175623 A1 11/2002 Kim et al.
2004/0051457 A1 * 3/2004 Kimura et al. ..... 313/586
2005/0093444 A1 * 5/2005 Woo et al. ..... 313/582

FOREIGN PATENT DOCUMENTS

| | | |
|---|---|---|
| JP | 06-267430 | 9/1994 |
| JP | 06-310040 | 11/1994 |
| JP | 2002-150945 | 5/2002 |
| WO | WO 02/19367 | 3/2002 |

OTHER PUBLICATIONS

Office action from the Japanese Patent Office issued in Applicant's corresponding Japanese Patent Application No. 2006-042974 dated Jan. 20, 2009.

* cited by examiner

*Primary Examiner*—Sikha Roy
*Assistant Examiner*—Tracie Y Green
(74) *Attorney, Agent, or Firm*—Robert E. Bushnell, Esq.

(57) ABSTRACT

A Plasma Display Panel (PDP) includes a plurality of substrates, dielectric walls, X-electrodes, Y-electrodes, and red, green, and blue phosphor layers. The substrates include front and rear substrates disposed opposite each other. The dielectric walls are disposed between the front and rear substrates to define discharge cells along with the substrates. Each of the X-electrodes includes first and second X-electrodes, separately disposed along a circumference of the discharge cell, and buried in the dielectric wall. Each of the Y-electrodes includes first and second Y-electrodes, separately disposed along the circumference of the discharge cell, and buried in the dielectric wall. Red, green, and blue phosphor layers are coated in the discharge cells. At least one of the X- and Y-electrodes, which starts a main discharge, has a different area from the other electrodes.

21 Claims, 3 Drawing Sheets

PLASMA DISPLAY PANEL (PDP) HAVING LOW CAPACITANCE AND HIGH DISCHARGE EFFICIENCY

CLAIM OF PRIORITY

This application makes reference to, incorporates the same herein, and claims all benefits accruing under 35 U.S.C. § 119 from an application for PLASMA DISPLAY PANEL earlier filed in the Korean Intellectual Property Office on 28 Feb. 2005 and there duly assigned Serial No. 10-2005-0016358.

BACKGROUND OF THE INVENTION

1. Field of the Invention

The present invention relates to a Plasma Display Panel (PDP), and more particularly, to a PDP in which each of a pair of discharge sustain electrodes required for a sustain discharge is separated into two or more sub-electrodes and simultaneously, the separated sub-electrodes are formed in different areas, with the result that the PDP has a low capacitance and a high discharge efficiency.

2. Description of the Related Art

In general, a PDP is a Flat Panel Display (FPD) in which when a discharge gas is injected between two substrates on which a plurality of discharge electrodes are formed, a discharge occurs in the gas between the substrates, creating ultraviolet rays which excite fluorescent materials of phosphor layers, thereby forming a desired number, a letter, or a graphic image.

A conventional PDP includes a front substrate and a rear substrate. On an inner surface of the front substrate, a pair of sustain discharge electrodes (i.e., an X-electrode and a Y-electrode), a front dielectric layer, and a protective layer are sequentially formed. The front dielectric layer buries the X- and Y-electrodes, and the protective layer is disposed on the surface of the front dielectric layer are sequentially formed. Also, an electrode and a rear dielectric layer are formed on an inner surface of the rear substrate. The address electrode is disposed substantially perpendicular to the pair of discharge sustain electrodes, and the rear dielectric layer buries the address electrode.

Partition walls are disposed between the front substrate and the rear substrate to define discharge spaces, and red, green, and blue phosphor layers are coated inside the partition walls.

The functions of the conventional PDP having the above-described structure are as follows.

First, electrical signals are respectively supplied to the Y-electrode and the address electrode to select a discharge cell at the intersection thereof. Thereafter, an electrical signal is alternately supplied to the X- and Y-electrodes so that a surface discharge occurs, thereby creating ultraviolet rays. The red, green, and blue phosphor layers coated in the selected discharge cell emit visible light in response to the ultraviolet rays to create a still image or a moving image.

However, since not only the X- and Y-electrodes but also the front dielectric layer and the protective layer are sequentially formed on the inner surface of the front substrate, the front substrate transmits the visible rays emitted from the discharge cell at a transmissivity of less than 60%. For this reason, the conventional PDP cannot properly function as a highly efficient FPD.

Second, when the panel is driven for a long duration of time, a discharge diffuses toward the phosphor layers. The charged particles of the discharge gas cause ion sputtering to the phosphor layers through an electric field, thereby inducing a permanent afterimage.

Third, a discharge diffuses from a discharge gap between the X- and Y-electrodes toward outside of the discharge cell. Since the discharge diffuses along a plane of the front substrate, the conventional PDP makes poor use of the entire space of the discharge cell.

Fourth, when a discharge gas containing a high-concentration Xe gas with a 10% volume or higher is injected into the discharge cell, charged particles and excitons are on the increase due to the ionization and excitation reaction of atoms so that luminance and discharge efficiency are enhanced. However, owing to the application of the high-concentration Xe gas, an initial discharge firing voltage is undesirably elevated.

SUMMARY OF THE INVENTION

The present invention provides a Plasma Display Panel (PDP) having an improved structure in which discharge electrodes are disposed along circumferences of discharge cells, thus elevating the transmissivity of visible rays.

Also, the present invention provides a PDP in which each of a pair of discharge sustain electrodes installed along a circumference of a discharge space is separated into two or more sub-electrodes and at least one discharge sustain electrode required for a main discharge has a smaller area than other discharge sustain electrodes, with the result that a waste of power is prevented to improve discharge efficiency.

According to an aspect of the present invention, a PDP is provided including a plurality of substrates, dielectric walls, X-electrodes, Y-electrodes, and red, green, and blue phosphor layers. The substrates include front substrate and a rear substrate that are disposed opposite each other. The dielectric walls are disposed between the front and rear substrates to define discharge cells along with the substrates. Each of the X-electrodes includes a first X-electrode and a second X-electrode, which are separately disposed along a circumference of the discharge cell, and is buried in the dielectric wall. Each of the Y-electrodes includes a first Y-electrode and a second Y-electrode, which are separately disposed along the circumference of the discharge cell, and is buried in the dielectric wall. Also, the red, green, and blue phosphor layers are coated in the discharge cells. At least one of the X- and Y-electrodes, which starts a main discharge, has a different area than that of the other electrodes.

The first X-electrode is preferably continuously disposed along adjacent discharge cells in one direction of the front and rear substrates, the second X-electrode is preferably disposed under and separated from the first X-electrode in the same direction as the first X-electrode, and the first and second X-electrodes are preferably electrically connected to each other.

The first X-electrodes preferably define either an open loop or a closed loop along the circumference of each of the discharge cells, and the second X-electrodes are preferably disposed as stripes in one direction of the front and rear substrates.

The second X-electrode preferably has a smaller area than the first X-electrode.

The first Y-electrode is preferably continuously disposed along the adjacent discharge cells in one direction of the front and rear substrates, the second Y-electrode is preferably disposed over and separated from the first Y-electrode in the same direction as the first Y-electrode, and the first and second Y-electrodes are preferably electrically connected to each other.

The first Y-electrodes preferably define either an open loop or a closed loop along the circumference of each of the discharge cells, and the second Y-electrodes are preferably disposed as stripes in one direction of the front and rear substrates.

The second Y-electrode preferably has a smaller area than the first Y-electrode.

The PDP of the present invention preferably further includes address electrodes, which extend in the discharge cells at right angles to the X- and Y-electrodes to induce addressing discharge, and the X- and Y-electrodes are preferably continuously arranged in one direction of the front and rear substrates along circumferences of adjacent discharge cells.

Each of the dielectric walls preferably includes a first dielectric wall disposed in one direction of the front and rear substrates; and a second dielectric wall disposed in the other direction of the front and rear substrates, wherein the second dielectric wall integrally extends from the inside of a pair of adjacent first dielectric walls opposite the first dielectric walls.

The PDP of the present invention preferably further includes partition walls, which are disposed between the dielectric walls and the rear substrate to define the discharge cells along with the dielectric walls, and the phosphor layers are coated inside the partition walls.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

A Plasma Display Panel (PDP) according to the present invention is described more fully hereinafter with reference to the accompanying drawings, in which exemplary embodiments of the present invention are shown.

Figure 1:
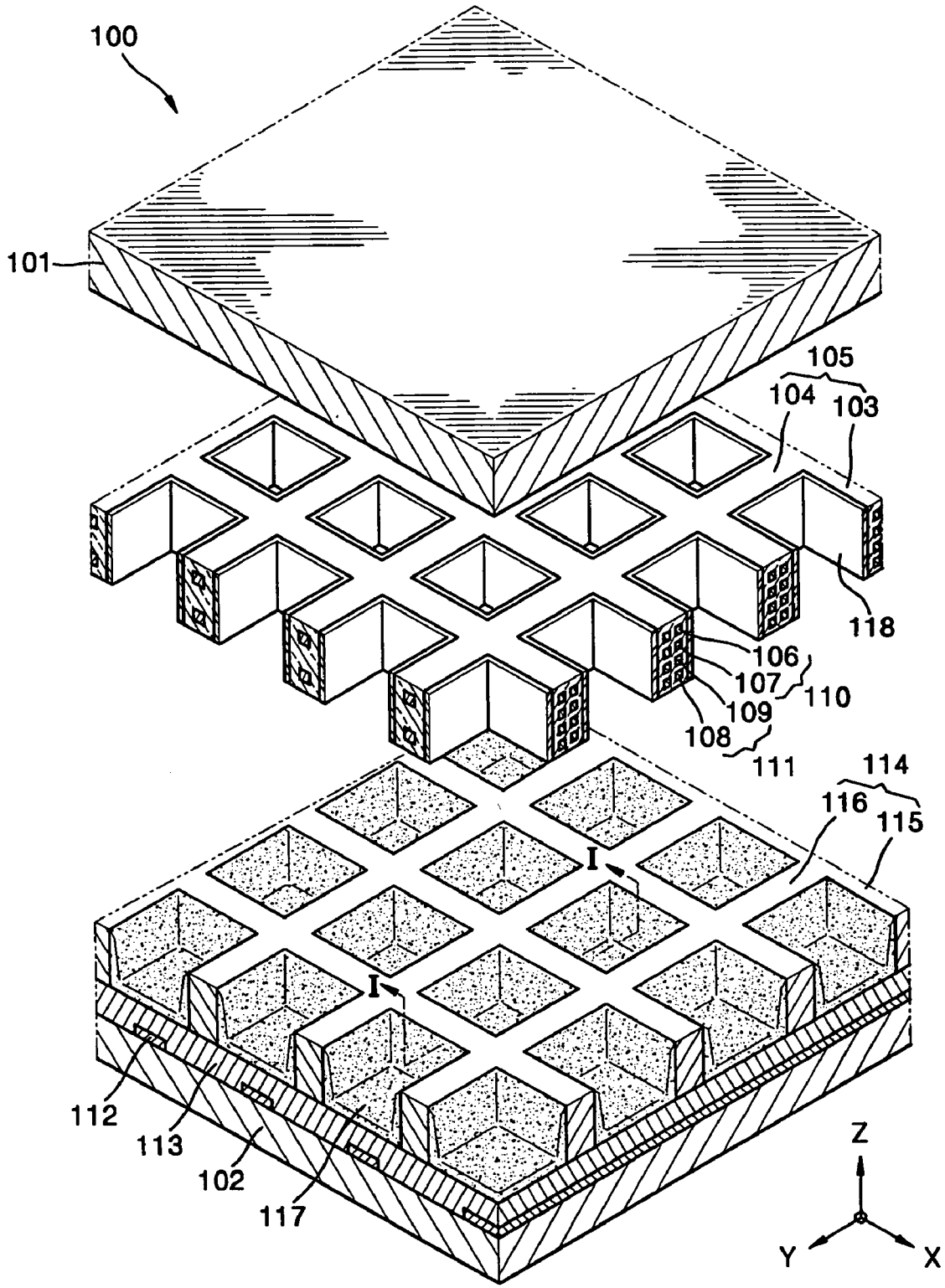
FIG. 1 is a discrete perspective view of a portion of a Plasma Display Panel (PDP) according to an exemplary embodiment of the present invention.

FIG. 1 is a discrete perspective view of a portion of a PDP according to an exemplary embodiment of the present invention.

Referring to FIG. 1, the PDP 100 includes a front substrate 101 and a rear substrate 102 that is disposed parallel to the front substrate 101. Frit glass is coated on edges of inner surfaces of the front and rear substrates 101 and 102, so the front and rear substrates 101 and 102 are attached to each other to hermetically seal an inner space therebetween.

The front substrate 101 is formed of a transparent material, for example, soda lime glass. The rear substrate 102 is substantially formed of the same material as the front substrate 101.

Dielectric walls 105 are disposed between the front and rear substrates 101 and 102 to define discharge cells. The dielectric walls 105 are formed of a high-dielectric material, such as a glass paste to which various fillers have been added.

Each of the dielectric walls 105 includes a first dielectric wall 103, which is disposed in an X direction of the front substrate 101, and a second dielectric wall 104, which is disposed in a Y direction thereof. The second dielectric walls 104 integrally extend from the inside of the first dielectric walls 103 opposite the first dielectric walls 103. The first and second dielectric walls 103 and 104 are combined into a matrix, and accordingly, the discharge cells have a rectangular shape.

In other embodiments, the dielectric walls 105 can have other various shapes, for example, a meander shape, a delta shape, or a honeycomb shape. Also, the discharge cells defined by the dielectric walls 105 can have various different structures, such as a hexagonal shape, an elliptical shape, and a circular shape, and are not restricted to the rectangular shape.

X-electrodes 110 and Y-electrodes 111 are buried in the dielectric walls 105. The X- and Y-electrodes 110 and 111 are not disposed within the discharge cells but rather are disposed along circumferences of the discharge cells. The X- and Y-electrodes 110 and 111 are electrically insulated from each other and voltages are supplied to the X- and Y-electrodes 110 and 111 at different levels.

A protective layer 118 is deposited using, for example, magnesium oxide(MgO), on inner surfaces of the dielectric walls 105, so that secondary electrons are emitted along four sidewalls of the discharge cells.

Partition walls 114 can be further installed between the dielectric walls 105 and the rear substrate 102. The partition walls 114 are formed of a low-dielectric material unlike the dielectric walls 105. The partition walls 114 are substantially disposed in the same shape as the dielectric walls 105 such that they correspond to the dielectric walls 105.

Each of the partition walls 114 includes a first partition wall 115, which is disposed parallel to the first dielectric wall 103, and a second partition wall 116, which is disposed parallel to the second dielectric wall 104. The first and second partition walls 115 and 116 are integrally combined into a matrix.

When only the dielectric walls 105 are disposed between the front and rear substrates 101 and 102, the discharge cells are defined by single walls. When both the dielectric walls 105 and the partition walls 114 are disposed between the front and rear substrates 101 and 102, the discharge cells are defined by double walls formed of materials with different dielectric constants.

Address electrodes 112 are disposed on a top surface of the rear substrate 102 in a direction to cross to the X- and Y-electrodes 110 and 111. The address electrodes 112 are disposed within the discharge cells and buried by a dielectric layer 113.

In the PDP 100, discharge electrodes can be variously arranged depending on whether the PDP 100 is formed as a surface discharge PDP, an opposing discharge PDP, or a hybrid PDP. In the present embodiment, the X- and Y-electrodes 110 and 111 are installed to induce a display sustain discharge, and the address electrodes 112 are further installed perpendicular to the X- and Y-electrodes 110 and 111 to induce an addressing discharge. The address electrodes 112 can be buried in not only the rear substrate 102 but can also be buried in the dielectric walls 105 in which the X- and Y-electrodes 110 and 111 are buried.

A discharge gas, such as Ne—Xe gas or He—Xe gas, is injected in the discharge cells that are defined by the front and rear substrates 101 and 102, the dielectric walls 105, and the partition walls 114.

Also, red, green, and blue phosphor layers 117 are formed in the discharge cells. As described above, the phosphor layers 117 are excited by ultraviolet rays created by the discharge gas and emit visible light. In the present embodiment, the phosphor layers 117 are coated on inner sidewalls of the partition walls 114 and atop surface of the dielectric layer 113. However, the present invention is not limited to the above description. Rather, the phosphor layers 117 can be coated in any region of the discharge cells.

The red, green, and blue phosphor layers 117 are separately coated in the respective discharge cells. The red phosphor layers can be formed of $(Y,Gd)BO_3$; $Eu^{+3}$, the green phosphor layers can be formed of $Zn_2SiO_4$:$Mn^{2+}$, and the blue phosphor layers can be formed of $BaMgAl_{10}O_{17}$:$Eu^{2+}$.

Each of the X-electrodes 110 includes a first X-electrode 106 and a second X-electrode 107 that are separated from each other along the circumference of one of the discharge cells, and each of the Y-electrodes 111 includes a first Y-electrode 108 and a second Y-electrode 109 that are separated from each other along the circumference of one of the discharge cells. At least one of the X- and Y-electrodes 110 and 111 includes two electrodes with different areas. In other words, the first and second X-electrodes 106 and 107 can have different areas and/or the first and second Y-electrodes 108 and 109 can have different areas.

The above-described structure is described below in more detail with reference to FIGS. 2 and 3.

Figure 2:
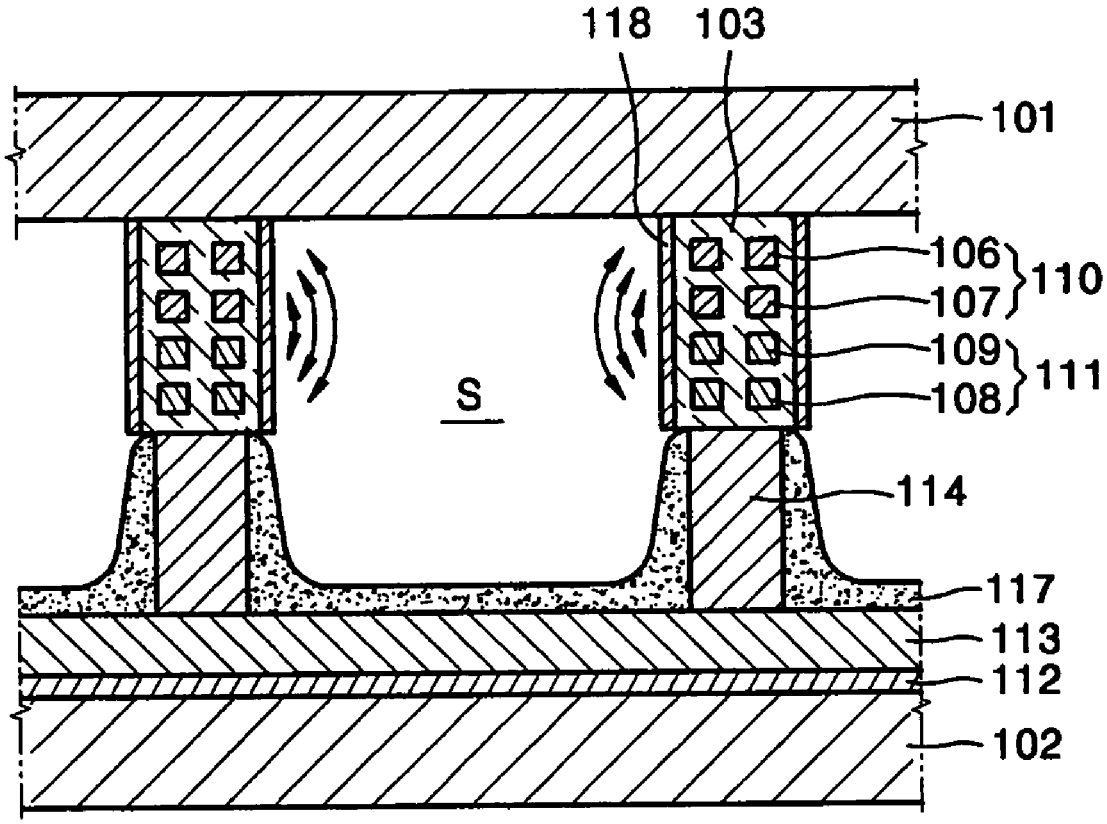
FIG. 2 is a cross-sectional view taken along a line I-I of a combined view of the PDP of FIG. 1.
Figure 3:
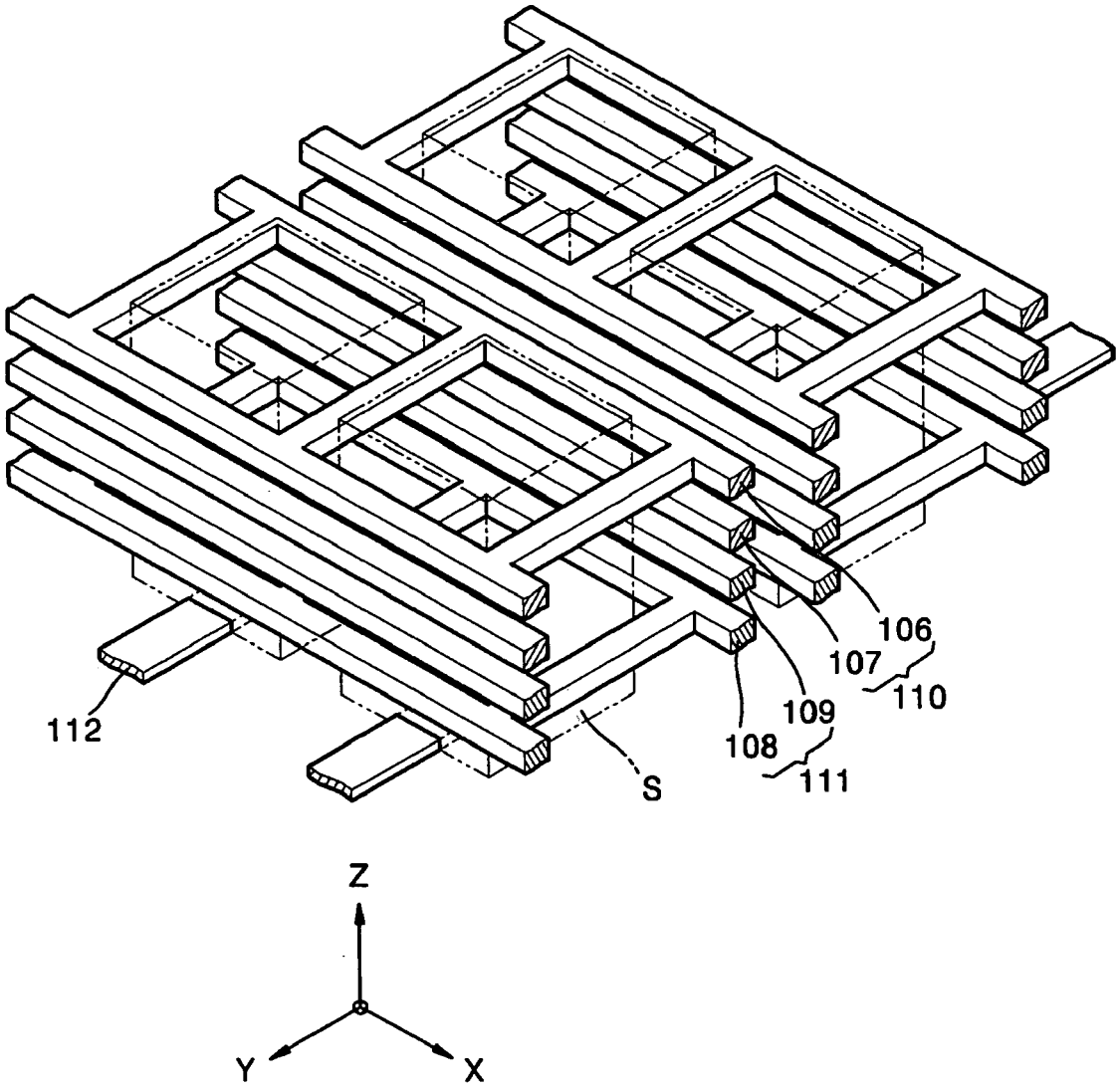
FIG. 3 is a discrete perspective view of a discharge electrode of FIG. 1.

FIG. 2 is a cross-sectional view taken along a line I-I of the PDP of FIG. 1, and FIG. 3 is a discrete perspective view of the discharge electrode of FIG. 1.

Referring to FIGS. 2 and 3, the X-electrodes 110 are continuously arranged along adjacent discharge cells formed in one direction. Each of the X-electrodes 110 includes the first and second X-electrodes 106 and 107. The first X-electrode 106 is relatively close to the front substrate 101, and the second X-electrode 107 is relatively close to the rear substrate 102. The first and second X-electrodes 106 and 107 are vertically separated from each other.

Also, the second X-electrode 107 is disposed under the first X-electrode 106 in substantially the same direction as the first X-electrode 106 and is electrically connected to the first X-electrode 106 on an edge of the panel 100.

The first X-electrodes 106 are arranged in a closed loop or open loop around each of the discharge cells. That is, the first X-electrodes 106 make a continuous loop or a discontinuous loop having at least one disconnected portion around each of the discharge cells.

In comparison with the first X-electrodes 106, the second X-electrodes 107 make neither a closed loop nor a open loop around each of the discharge cells, but are arranged as stripes in one direction of the substrates 101 and 102, namely, in the same direction as the first X-electrodes 106 that are continuously arranged along the circumferences of the adjacent discharge cells. The second X-electrodes 107 are disposed only in positions corresponding to the first dielectric walls 103. A plurality of second X-electrodes 107 can be installed on a pair of first dielectric walls 103 that define the discharge cell or installed on at least one first dielectric wall 103.

The second X-electrode 107 has a smaller area than the first X-electrode 106. This is because the first X-electrode 106 extends in the second dielectric wall 104 to correspond to the second dielectric wall 104, whereas the second X-electrode 107 does not extend along the second dielectric wall 104.

The Y-electrodes 111 are continuously arranged along adjacent discharge cells that are formed in one direction of the substrates 101 and 102. Each of the Y-electrode 111 includes the first and second Y-electrodes 108 and 109. The first Y-electrode 108 is relatively close to the rear substrate 102, and the second Y-electrode 109 is relatively close to the front substrate 101. The first and second Y-electrodes 108 and 109 are vertically separated from each other.

Also, the second Y-electrode 109 is separately disposed over the first Y-electrode 108 in the same direction as the first Y-electrode 108 and electrically connected to the first Y-electrode 108 on the edge of the panel 100.

The first Y-electrodes 108 are disposed in an open loop or closed loop around each of the discharge cells. The arrangement of the first Y-electrodes 108 depends on a structure of defining the discharge cells using the dielectric walls 105. That is, the first Y-electrodes 108 make a discontinuous loop having at least one disconnected portion or a continuous loop along the circumferences of the dielectric walls 105.

In comparison to the first Y-electrodes 108, the second Y-electrodes 109 are arranged as stripes in the same direction as the first Y-electrodes 108. The second Y-electrodes 109 are arranged in the direction in which the first dielectric wall 103 is disposed. A plurality of second Y-electrodes 109 are buried in a pair of first dielectric walls 103 that define the discharge cells or in at least one first dielectric wall 103.

As described above, the second Y-electrode 109 is arranged as a stripe along the first dielectric wall 103, and the first Y-electrode 108 is arranged as a rectangular along the first and second dielectric walls 103 and 104. Therefore, the second Y-electrode 109 has a smaller area than the first Y-electrode 108.

The Y-electrode 111 is disposed under the X-electrode 110, and the second X- and Y-electrodes 107 and 109, which start a main discharge, are disposed opposite each other.

The address electrode 112, which provokes an address discharge with the Y-electrode 111, extends across adjacent discharge cells such that it intersects the X- and Y-electrodes 110 and 111. The address electrodes 112 are arranged a predetermined distance apart from one another on the inner surface of the rear substrate 102 and buried in the dielectric layer 113.

Among the separated X- and Y-electrodes 110 and 111, the second X- and Y-electrodes 107 and 109, which are closely disposed opposite each other, are arranged as stripes until the first X- and Y-electrodes 106 and 108 for the following reason.

Because the second X- and Y-electrodes 107 and 109, which start a main discharge, have smaller areas than the first X- and Y-electrodes 106 and 108, the capacitance of the panel 100 decreases.

Given the same dielectric constant, the capacitance is in inverse proportion to distance and in proportion to area ($C=\in S/d$). Thus, the smaller the areas of the second X- and Y-electrodes 107 and 109 become, the lower the capacitance of the panel 100 becomes.

Therefore, when the same voltage is supplied, since the second X- and Y-electrodes 107 and 109 have smaller respective areas than the first X- and Y-electrodes 106 and 108, the capacitance C of the panel 100 decreases, and thus, the current grows smaller. As a result, the panel 100 consumes less power, thereby improving discharge efficiency.

The functions of the PDP 100 having the above-described structure is described below in detail with reference to FIGS. 1 through 3.

At the outset, when a predetermined address voltage is supplied from an external power supply between the address electrodes 112 and the Y-electrodes 111, a discharge cell for emission is selected. Wall charges are accumulated on the Y-electrodes 111 formed in the selected discharge cell.

Thereafter, a positive "+" voltage is supplied to the X-electrodes 110 and a higher voltage is supplied to the Y-electrodes 111. Thus, the wall charges move due to a voltage difference between the X- and Y-electrodes 110 and 111.

As the wall charges move, they collide with atoms of the discharge gas in the discharge space, thus causing a discharge to generate a plasma. This discharge has a good chance to arise from gaps between the X- and Y-electrodes 110 and 111 where a stronger electric field is formed.

Since the X- and Y-electrodes 110 and 111 are formed along four lateral surfaces of the discharge space, the discharge is far more likely to occur.

Subsequently, as time passes by, when the voltage difference between the X- and Y-electrodes 110 and 111 is held sufficiently high, the electric field strongly concentrates therebetween. Consequently, the discharge diffuses into the entire discharge space.

In the present embodiment, the discharge arises from the four lateral surfaces of the discharge space, thus the range of discharge diffusion greatly increases. Also, because plasma caused by the discharge is generated along the lateral surfaces of the discharge space and diffuses into the center, the volume of plasma becomes far larger, thus resulting in emission of much more visible rays. Furthermore, as the plasma diffuses into the center of the discharge space, space charges can be utilized so that the PDP 100 can be driven at a low voltage and have excellent luminous efficiency.

After the discharge is induced in the above-described manner, when the voltage difference between the X- and Y-electrodes 110 and 111 is lower than a discharge voltage, the discharge does not occur any longer, but space charges and wall charges are formed in the discharge space. By exchanging polarities of voltages supplied to the X- and Y-electrodes 110 and 111, a discharge again arises with the help of the wall charges. Once the polarities of the X- and Y-electrodes 110 and 111 are exchanged directly, the initial discharge process is repeated. Thus, a stable discharge is induced while repeating the above-described process.

Ultraviolet rays created by the discharge process excite fluorescent materials of the phosphor layers 117 coated in the discharge space. As a result, visible light radiates from the fluorescent materials to embody an image.

For the X- and Y-electrodes 110 and 111 arranged along the circumference of the discharge space, the second X- and Y-electrodes 107 and 109, which are disposed facing each other, have a stripe shape, while the first X-electrode 106 disposed over the second X-electrode 107 and the first Y-electrode 108 disposed under the second Y-electrode 109 form an open or closed loop. Therefore, the second X- and Y-electrodes 107 and 109, which start a main discharge, have smaller areas than the first X- and Y-electrodes 106 and 108. Accordingly, the capacitance of the panel 100 decreases, thus reducing consumed power.

As explained above, in the PDP of the present invention, each of X- and Y-electrodes disposed along a circumference of a discharge cell is separated into two or more sub-electrodes, and at least one of the X- and Y-sub-electrodes, which start a main discharge, has a smaller area than other sub-electrodes. In this structure, the following effects can be obtained.

First, an electrode, which initiates main discharge, has a smaller area than other electrode that is electrically connected to the electrode, so that the capacitance of the PDP decreases to reduce current amount. As a result, consumed power is reduced to improve the efficiency of the PDP.

Second, the present invention enables a stable sustain discharge between X- and Y-electrodes.

Third, a wide voltage margin can be secured, thus enabling a stable discharge of the PDP.

Fourth, as a discharge occurs along a circumference of a discharge space, a discharge surface is greatly enlarged.

Fifth, neither a discharge electrode nor a dielectric layer that buries the discharge electrode is formed on an inner surface of a substrate that faces the discharge space. As a result, an aperture ratio greatly increases.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Plasma Display Panel (PDP) comprising:

a plurality of substrates including a front substrate and a rear substrate that are disposed opposite each other;

dielectric walls disposed between the front and rear substrates to define discharge cells along with the substrates;

X-electrodes, each X-electrode including a first X-electrode and a second X-electrode, which are separately disposed along a circumference of the discharge cell, and buried in the dielectric wall;

Y-electrodes, each Y-electrode including a first Y-electrode and a second Y-electrode, which are separately disposed along the circumference of the discharge cell, and buried in the dielectric wall; and red, green, and blue phosphor layers coated in the discharge cells, wherein at least one of the X- and Y-electrodes, which starts a main discharge, has a different area than that of the other electrodes.

2. The PDP according to claim 1, wherein the first X-electrode is continuously disposed along adjacent discharge cells in one direction of the front and rear substrates the second X-electrode is disposed under and separated from the first X-electrode in the same direction as the first X-electrode, and the first and second X-electrodes are electrically connected to each other.

3. The PDP according to claim 2, wherein the first X-electrodes defines either an open loop or a closed loop along the circumference of each of the discharge cells, and the second X-electrodes are disposed as stripes in one direction of the front and rear substrates.

4. The PDP according to claim 3, wherein the second X-electrode has a smaller area than the first X-electrode.

5. The PDP according to claim 1, wherein the first Y-electrode is continuously disposed along the adjacent discharge cells in one direction of the front and rear substrates, the second Y-electrode is disposed over and separated from the first Y-electrode in the same direction as the first Y-electrode, and the first and second Y-electrodes are electrically connected to each other.

6. The PDP according to claim 5, wherein the first Y-electrodes define either an open loop or a closed loop along the circumference of each of the discharge cells, and the second Y-electrodes are disposed as stripes in one direction of the front and rear substrates.

7. The PDP according to claim 6, wherein the second Y-electrode has a smaller area than the first Y-electrode.

8. The PDP according to claim 2, wherein the Y-electrode is disposed under the X-electrode, and the second X- and Y-electrodes are disposed facing each other.

9. The PDP according to claim 3, wherein the Y-electrode is disposed under the X-electrode, and the second X- and Y-electrodes are disposed facing each other.

10. The PDP according to claim 4, wherein the Y-electrode is disposed under the X-electrode, and the second X- and Y-electrodes are disposed facing each other.

11. The PDP according to claim 5, wherein the Y-electrode is disposed under the X-electrode, and the second X- and Y-electrodes are disposed facing each other.

12. The PDP according to claim 6, wherein the Y-electrode is disposed under the X-electrode, and the second X- and Y-electrodes are disposed facing each other.

13. The PDP according to claim 7. wherein the Y-electrode is disposed under the X-electrode, and the second X- and Y-electrodes are disposed facing each other.

14. The PDP according to claim 2, further comprising address electrodes extending in the discharge cells in a direction to cross the X- and Y-electrodes to induce an address discharge;

wherein the X- and Y-electrodes are continuously arranged in one direction of the front and rear substrates along circumferences of adjacent discharge cells.

15. The PDP according to claim 3, further comprising address electrodes extending in the discharge cells in a direction to cross the X- and Y-electrodes to induce an address discharge;

wherein the X- and Y-electrodes are continuously arranged in one direction of the front and rear substrates along circumferences of adjacent discharge cells.

16. The PDP according to claim 4, further comprising address electrodes extending in the discharge cells in a direction to cross the X- and Y-electrodes to induce an address discharge;

wherein the X- and Y-electrodes are continuously arranged in one direction of the front and rear substrates along circumferences of adjacent discharge cells.

17. The PDP according to claim 5, further comprising address electrodes extending in the discharge cells in a direction to cross the X- and Y-electrodes to induce an address discharge;

wherein the X- and Y-electrodes are continuously arranged in one direction of the front and rear substrates along circumferences of adjacent discharge cells.

18. The PDP according to claim 6, further comprising address electrodes extending in the discharge cells in a direction to cross the X- and Y-electrodes to induce an address discharge;

wherein the X- and Y-electrodes are continuously arranged in one direction of the front and rear substrates along circumferences of adjacent discharge cells.

19. The PDP according to claim 7, further comprising address electrodes extending in the discharge cells in a direction to cross the X- and Y-electrodes to induce an address discharge;

wherein the X- and Y-electrodes are continuously arranged in one direction of the front and rear substrates along circumferences of adjacent discharge cells.

20. A Plasma Display Panel (PDP) comprising:

a plurality of substrates including a front substrate and a rear substrate that are disposed opposite each other;

dielectric walls disposed between the front and rear substrates to define discharge cells along with the substrates;

X-electrodes, each X-electrode including a first X-electrode and a second X-electrode, which are separately disposed along a circumference of the discharge cell, and buried in the dielectric wall;

Y-electrodes, each Y-electrode including a first Y-electrode and a second Y-electrode, which are separately disposed along the circumference of the discharge cell. and buried in the dielectric wall; and red, green, and blue phosphor layers coated in the discharge cells, wherein at least one of the X- and Y-electrodes, which starts a main discharge, has a different area than that of the other electrodes; and wherein each of the dielectric walls includes;

a first dielectric wall disposed in one direction of the front and rear substrates; and a second dielectric wall disposed in another direction of the front and rear substrates;

wherein the second dielectric wall integrally extends from the inside of a pair of adjacent first dielectric walls opposite the first dielectric walls.

21. The PDP according to claim 1, further comprising partition walls disposed between the dielectric walls and the rear substrate to define the discharge cells along with the dielectric walls;

wherein the phosphor layers are coated inside the partition walls.

* * * * *